United States Patent [19]

Northup

[11] Patent Number: 4,721,220

[45] Date of Patent: Jan. 26, 1988

[54] THREADED CONTAINER AND CLOSURE

[75] Inventor: John D. Northup, Toledo, Ohio

[73] Assignee: Owens-Illinois Closure Inc., Toledo, Ohio

[21] Appl. No.: 901,848

[22] Filed: Aug. 29, 1986

[51] Int. Cl.[4] ..... B65D 41/04

[52] U.S. Cl. ..... 215/307; 215/329

[58] Field of Search ..... 215/307, 329, 332; 220/367, 373, 366

[56] References Cited

U.S. PATENT DOCUMENTS

| | | | |
|---|---|---|---|
| 612,449 | 12/1926 | Lee | 215/337 X |
| 1,783,314 | 12/1930 | Scofield | 215/337 |
| 2,990,079 | 6/1961 | Garvey | 215/329 X |
| 4,202,462 | 5/1980 | Imber | 215/337 X |

*Primary Examiner*—Donald F. Norton
*Attorney, Agent, or Firm*—H. G. Bruss

[57] ABSTRACT

A closure having interrupted threads, wherein the interruptions between thread segments are vertically aligned with and are at least as long as thread segments in the overlapping portions of the turns of the thread. This permits manufacture of the closure by stripping of the closure threads from a mold to obtain a higher rate of production while minimizing the pulled-thread defects previously encountered with this production method. In addition, the invention is also utilized to provide an improved closure and package in which two hand operations by the user are required to remove the closure from a neck, thereby permitting internal pressure to be released through interrupted threads before the closure and neck threads are completely disengaged.

16 Claims, 6 Drawing Figures

THREADED CONTAINER AND CLOSURE

BACKGROUND OF THE INVENTION

1. Field of the Invention

This invention relates generally to package systems and, more particularly, to a screw type closure application which incorporates an improved safety feature and enables improved productivity of the closure.

2. Description of the Prior Art

Screw cap or closure systems fall into two general categories. In the first class the caps have a continuous internal thread which cooperates with a corresponding external thread formed on the neck portion or finish of a container. In the second class, caps have a plurality of spaced lugs or have interrupted threads formed on the internal surface of a skirt wall, which cooperate with corresponding cams or interrupted thread segments formed on the external surface of the neck portion or finish of a container. The first class is so common that examples will not be cited here. The second class is illustrated in U.S. Pat. Nos. 1,612,449 and 4,202,462.

In addition to the two general classes discussed above there are hybrids which use spaced interrupted threads on a closure in combination with continuous threads on a neck portion of a container. U.S. Pat. No. 1,783,314 discloses a two-piece metal closure in which a flat strip of metal is bent into a tubular form with the ends interlocked to form a seam. A button top is then attached to the tube. Two turns of threads are interrupted at the seam to avoid deformation and disfiguration at the seam, and to fix the location of the seam with respect to the threads so that the seam will always be at the rear of the bottle. Although other embodiments illustrate the closure threads interrupted at more than one location, the thread segments are always vertically aligned with each other, as are the interruptions or spaces between the thread segments.

The trend today is toward closures which are molded from synthetic plastic materials. Such closures are in a single piece and typically consist of three main parts—a top wall, a skirt or cylindrical side wall depending from the top wall, and threads formed on the interior wall of the skirt. The top wall, in combination with any desired additional sealing means such as a liner or gasket, provides the necessary seal to protect the product in the container from the ambient environment and to retain internal pressures from carbonation and the like. The threads provide the capability of applying force to hold the closure in its sealing position on the container. The skirt acts as a link between the threads and the top wall.

For safety reasons it has been desirable to form more than one turn or 360 helical degrees of helical screw thread on the interior wall of the skirt of the closure, so that venting of internal pressures can occur before the threads in the closure and the threads on the neck of the container are disengaged. The length of such threads are as long as two turns or 720 helical degrees. Therefore, the user must perform at least two hand operations to remove the closure, permitting the internal pressure to vent. To aid in the venting process, some closures have provided vertically aligned gaps in the two or overlapping turns of thread, however the remaining thread portions are still vertically aligned with each other and suffer pulled-thread defects when molded closures are stripped from a mold.

In manufacturing a conventional unscrewing closure in a mold difficulties have been encountered. It has been a common practice to use an unscrewing device to remove a closure from the plug mold after the material has cured. However, the unscrewing adds time to the molding cycle and complexity to the molding equipment. In recent years, techniques have been developed for stripping the inside thread of a thermoplastic closure from the plug mold. Stripping is best used when the closure is designed with only one turn or 360 helical degrees of thread. As noted above, designs with more than one turn of thread tend to develop a defect known as pulled-threads in which the top of the threads are sheared by the force required to strip the closure from the plug mold.

SUMMARY OF THE INVETNTION

An improved package system is disclosed which includes a container having a cylindrical neck with an opening formed therein for dispensing the contents, and a closure for the container including a top wall and cylindrical side wall depending from the top wall.

In the preferred embodiment the neck has a continuous screw thread formed on a helical path on the external surface thereof, and extending for more than one full turn around the neck. The closure has thread means formed on a helical path on the interior surface of the closure skirt which corresponds to and mates with the continuous screw thread helical path on the neck.

The closure thread means includes interrupted thread segments formed on the closure helical path on the skirt. The closure helical path extends for more than one full turn around the skirt and thus has vertically overlapping portions. The thread segments are spaced from each other by interruptions which are vertically aligned with thread segments formed on the overlapping portions of the closure helical path. Each such interruption is at least as long as the thread segment aligned therewith.

An improved closure is also disclosed which includes a top wall, a skirt depending from the top wall, and screw thread means formed on a helical path on the interior surface of the skirt. The closure helical path corresponds to and mates with a continuous helical screw thread on the neck of a container which is to receive the closure.

The closure screw thread means includes a plurality of thread segments formed along and spaced from each other on the closure helical path. The closure helical path is defined by a beginning leading thread segment and a trailing end thread segment, and has a length which extends around the interior surface of the closure skirt for more than one turn and for a distance which requires at least two hand operations by a user to remove the closure from a container neck. The spaced thread segments are located on the helical path so that each segment is never vertically aligned on the interior wall of the skirt with any portion of another thread segment. The internal pressure is therefore relieved after a first hand operation is initiated by the user and before the closure is completely disengaged from the threads on the neck of a container.

By using interrupted thread segments which are vertically aligned with interruptions between the thread segments, the closure never effectively presents more than a total length of one full turn of thread to be stripped from the mold. This allows the use of the stripping technique to improve productivity of molded closures.

It is an object of this invention, therefore, to eliminate the use of a separate unscrewing mechanism in the manufacturing of molded closures. Tooling and mold maintenance costs would be reduced while productivity is substantially improved by reducing manufacturing time and defects.

It is a further object of this invention to provide a unique closure design which enhances the safety characteristics of the closure.

A further object of this invention is to provide an improved package in which a container has a neck with a minimum amount of continuous helical screw thread formed thereon to cooperate with a closure having a unique interrupted thread design which enhances the safety characteristics of the package.

Other objects, advantages and features of the invention will become apparent when the following description is taken in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENTS

Figure 2:
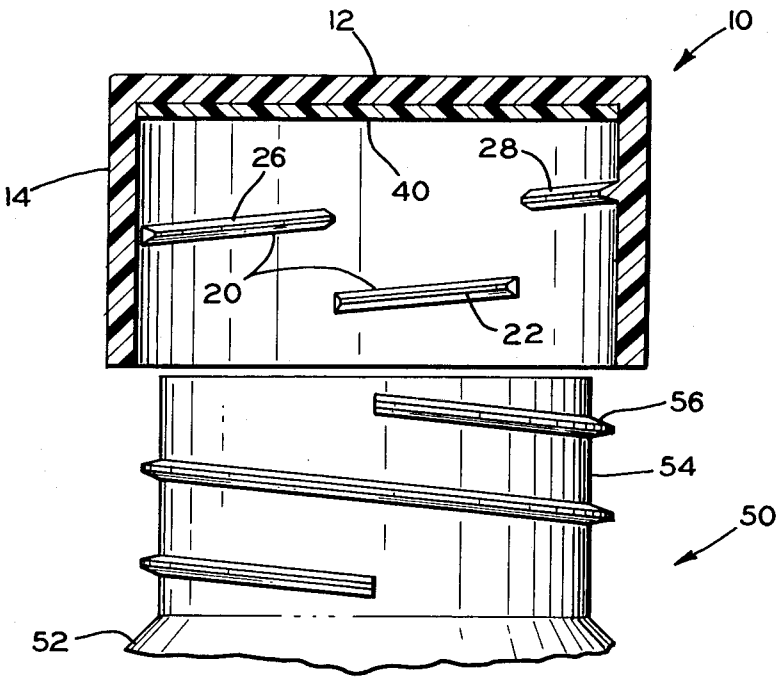
FIG. 2 is a cross-sectional view of the closure illustrated in FIG. 1, taken along lines II—II, along with a partial view of a container and the neck portion thereof showing the cooperative relationship of closure and neck.
Figure 1:
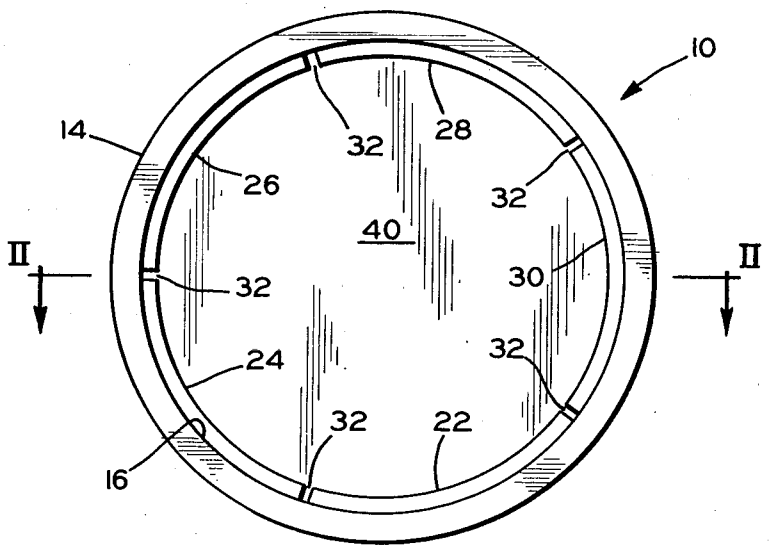
FIG. 1 is a bottom view of a closure embodying the teachings of this invention.
Figure 3:
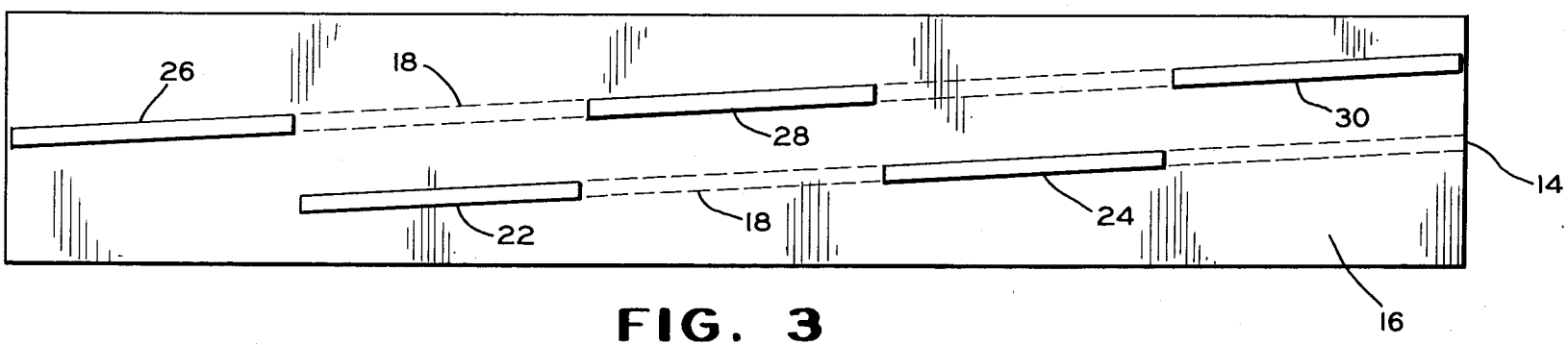
FIG. 3 is an elevational view of the internal wall of a skirt of the closure illustrated in FIGS. 1 and 2, which has been laid out flat to more clearly illustrate the disposition of thread segments thereon and their relative disposition with respect to the interruptions between the thread segments.

Referring now to FIGS. 1 through 3 there is illustrated a closure designated generally at 10 and, in FIG. 2, a container designated generally at 50 wbich disclose a preferred embodiment of this invention.

The closure 10 includes a top wall 12, a depending skirt or annular side wall 14, and thread means designated generally at 20 formed on a helical path or track 18 on the inner surface 16 of the skirt 14. A gasket, liner or other sealing means 40 may be provided below top wall 12. The helical track 18 is noted by dashed lines in FIG. 3 and is defined by an initial or leading interrupted thread segment 22 and a trailing or end thread segment 30, with intermediate thread segments 24, 26 and 28 being spaced along path 18.

The container 50 has a main body portion 52 and a neck or finish portion 54 having an opening formed therein for providing access to the interior of container 50. A continuous screw thread 56 is formed on the exterior surface of the neck 54 on a helical path. The neck helical path and the closure helical path correspond to and mate with each other so that the thread on the neck and the thread means cooperate to allow the closure 10 to be screwed on to neck 54 to seal the contents of the container 50 from the ambient environment. The continuous screw thread 56 is shown in FIG. 2 as extending for two full turns or 720 helical degrees so that any of the closure embodiments herein can be accomodated.

FIG. 3 is an elevational view of the interior wall 16 of the skirt 14 which has been laid out flat to more clearly illustrate the disposition of the interrupted thread segments thereon and their relative disposition with respect to the interruptions between the thread segments. As can be seen in FIG. 3, each thread segment is always vertically aligned on the inner wall 16 with an interruption between segments, and is never vertically aligned with another segment or portion thereof.

The helical path 18 in this embodiment extends for 1.8 turns or 648 helical degrees, while the sum of the length of the thread segments 20 together extend along only one turn or 360 helical degrees. This unique design cooperates with a continuous helical screw thread 56 on the neck 54 to require at least two hand operations by a user to completely remove the closure from the neck. Internal pressure is therefore relieved after a first hand operation is initiated by a user but before the closure thread segments are completely disengaged from the thread on the neck by completion of the second hand operation. Pressure is vented out through the interruptions in the thread segments, improving the safety of the closure.

In addition to the improved safety characteristics of the closure, it will be noted that the total length of the thread segments is no more than 360 helical degrees or one turn, with no segment overlap. Therefore, the closure can be manufactured from thermoplastic materials in a molding process which allows use of the stripping technique to remove the closure from the plug mold. Since the total segment length is less than 360 degrees or one turn, the pulled-thread defect normally associated with stripping techniques can be minimized. Thus, the production cycle time, the complexity of the mold equipment and the maintenance time required for the molds can be reduced, lowering the cost of producing the closures.

To improve both the venting capability of the closure and to further reduce the possibility of shearing the tops of the thread segments during the stripping of the closure from the mold, the closure can be designed so that the thread segments are shorter than the length of the interruptions between segments. As best seen in FIG. 1, this results in gaps or vertical vent passages 32 which will directly vent internal pressures to the outside.

The embodiment that is illustrated in FIGS. 1 through 3 is an example of the preferred embodiment when it is desired to obtain substantially one full turn of total thread segment contact with the continuous screw thread formed on the neck of the container, and if it is desired that the thread contact be equally distributed around the neck of the container. In such an embodiment, the thread segments are equal in length and the interruptions between the segments are also equal in length. If it is desired to provide the vertical vent feature then each thread segment is slightly shorter than the interruptions between segments to provide the gaps or vents 32 as illustrated in FIG. 1. If vertical vents are not desired, then each segment may be the same length as each interruption.

In any event, the equal spacing of thread segments of the same length permits all sectors of the skirt to act as direct links between the thread segments and the top panel of the closure. This insures that the entire periphery of the top panel is receiving the same amount of direct sealing force from the thread segments. This embodiment is preferred for applications where maximum sealing force is needed, e.g. where it is desired to have an extended shelf life for beverages exerting internal pressures at the higher end of the scale.

Finally, this embodiment also equally distributes the force required to strip the molded closure from the plug mold during the manufacturing process, again helping to reduce the probability of a pulled-thread defect.

To obtain equal distributions as discussed above, the sum of the number of thread segments plus the number of interruptions must always be an odd number for each 360 helical degrees or one full turn of the helical path on which the segments are formed. In the embodiment shown the sum of segments and interruptions is five, and the length of each interruption is 72 helical degrees. The length of each segment is also 72 helical degrees unless the direct vent gaps are desired, in which case the segments are slightly less than 72 helical degrees.

If the sum of segments and interruptions is three, then the length of each segment and each interruption is 120 helical degrees. If the sum of segments and interruptions is seven, then the length of each segment and each interruption is slightly more than 51 helical degrees.

Figure 4:
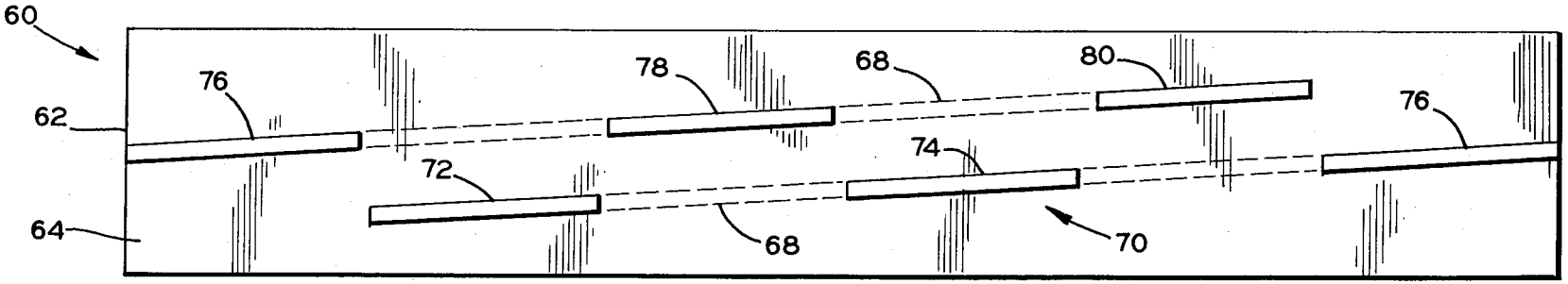
FIGS. 4, 5 and 6 are elevational views of internal walls of skirts of closures illustrating further embodiments of the teachings of this invention, with the walls again being laid out flat to more clearly illustrate the disposition of thread segments thereon and their relationship with the interruptions between the thread segments.

Referring now to FIG. 4 there is shown a second embodiment of a closure 60 illustrating the teachings of this invention. As in FIG. 3 the drawing of FIG. 4 is an elevational view of a skirt 62 which has been laid out flat to more clearly illustrate the disposition of thread means generally designated at 70 on a helical path 68 on the inner surface or wall 64 of the closure 60.

The helical path 68 shown in dashed lines is defined by a leading thread segment 72 and a trailing thread segment 80, with intermediate thread segments 74, 76 and 78 being spaced along path 68. The helical path 68 in this embodiment extends for one and two-thirds turns or 600 helical degrees, requiring two hand operations to remove the closure from the neck. This embodiment discloses that not all thread segments need be equal in length since segments 72, 74, 78 and 80 are sixty helical degrees while segment 76 extends for 120 helical degrees when the skirt 62 is rolled into tubular form and the ends are joined together. Thread contact for 360 helical degrees is provided. Since segment 76 is twice as long as the other segments, different stripping forces are required to remove this closure from a plug mold, but since only one full turn of total length of segments is used the stripping forces should be below the level required to minimize the pulled-thread defect.

Figure 5:
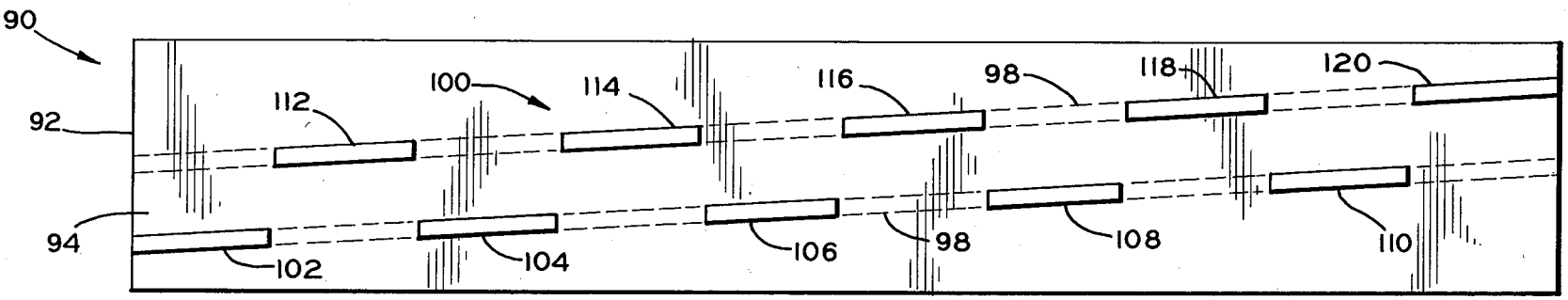

Referring now to FIG. 5 there is shown a third embodiment of a closure 90 illustrating the teachings of this invention. Again, it is an elevational view of a skirt 92 which has been laid out flat to more clearly illustrate the disposition of thread means 100 on a helical path 98 on the inner surface or wall 94 of the skirt 92.

The helical path 98 shown in dashed lines is defined by a leading thread segment 102 and a trailing thread segment 120, with intermediate segments 104, 106, 108, 110, 112, 114, 116 and 118 being spaced along path 98. The path 98 extends for two full turns or 720 helical degrees, again requiring at least two hand operations (and the most turns of the embodiments shown) to remove the closure from the neck.

This embodiment discloses that the segments may be the same length, but that an interruption (between segments 110 and 112) may be twice as long. Again one full turn or 360 helical degrees of thread contact is provided. Because of the longer interruption between segments 110 and 112 slightly different stripping forces are required to remove this embodiment from a plug mold than required for the previous embodiments, but still only one full turn of the total length of segments is used so again pulled-thread defects should be minimized.

Figure 6:
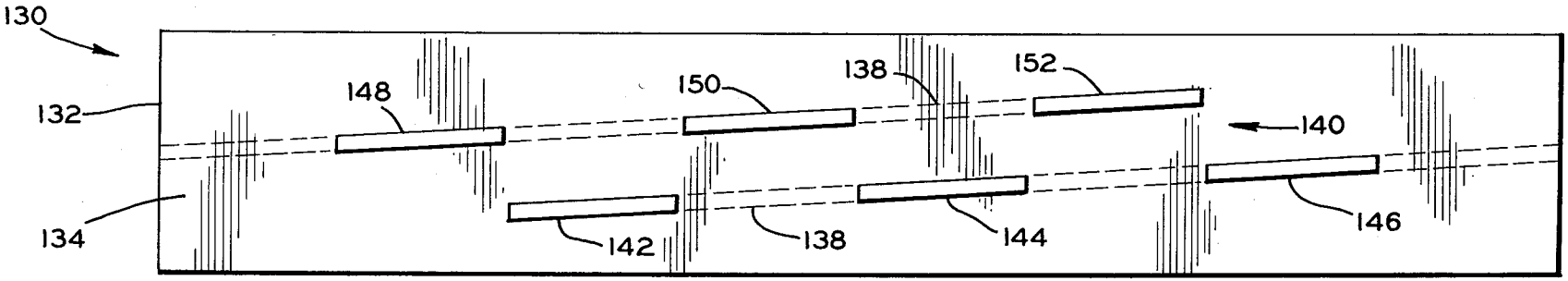

Referring now to FIG. 6 there is shown a fourth embodiment of a closure 130 illustrating the teachings of this invention. Once again it is an elevational view of a skirt 132 which has been laid out flat to more clearly illustrate the disposition of thread means 140 on a helical path 138 on the inner surface or wall 134 of a skirt 132.

The helical path 138 shown in dashed lines is defined by a leading thread segment 142 and a trailing segment 152, with intermediate segments 144, 146, 148 and 150 being spaced along path 138. In this instance the path 138 extends for only one and one-half turns or 540 helical degrees, which is nearing the minimum number of turns requiring the desired two hand operations by the user to remove the closure. The total length of the segments is three-fourths of a turn or 270 helical degrees of thread contact, which nears the minimum thread contact required to maintain internal pressures for most carbonated beverages.

The length of the segments in FIG. 6 are equal, but the length of the interruption between segments 146 and 148 is twice as long as a segment length. This closure will again require different stripping forces to remove it from a plug mold, with the forces being distributed unevenly but being less than forces required to remove a closure having 360 helical degrees of thread segments to substantially minimize the possibility of pulled-thread defects.

As noted, all of the above embodiments require two hand operations to achieve the desired venting of internal pressures before removal of the closure. Further, the minimum amount of thread contact required for sealing purposes can be provided, even though less than 360 helical degrees, and still meet the two hand operations goal by using interrupted thread segments spaced along a helical path. Finally, the invention can be utilized to improve the production process for molded plastic closures by minimizing pulled-thread defects. The different closure embodiments herein show variations of thread contact and removal turns required, so that the principles of the invention can be used to design a package that meets the specific needs for a particular application.

The principles of the invention may be applied to the use of interrupted threads on the finish or neck portion of the container and a continuous thread in the closure to achieve the safety features desired. Moreover, the invention applies to embodiments in which threads are formed on the inside of the neck and on the outside cylindrical wall of a closure which screws into the neck.

It should be noted that when a "continuous" thread is referred to herein, it is intended to cover the instances where there are discontinuities in an otherwise continuous thread, as opposed to the substantial sized interruptions between thread segments described herein. For example, when a glass container is formed in a mold the continuous thread on the neck or finish of the container is depressed at the seam formed where the two mold sections meet, providing a discontinuity but not an interruption between thread segments. As another example, when a plastic container is formed the mold may be designed to provide vertically aligned vent gaps in the otherwise continuous thread on the neck or finish. These vent gaps again are discontinuities rather than major interruptions between thread segments.

The form of the invention herein shown and described is to be taken as illustrative only, and changes in the shape, size and arrangement of the components, parts or portions may be made without departing from the spirit and scope of the invention.

I claim:

1. A package, comprising;

(a) a container having a cylindrical neck with an opening formed therein for dispensing the contents, said neck having thread means for mating with a closure thread means, said neck thread means being formed on a helical path on a surface thereof, said neck helical path extending for more than one full turn around said neck surface thereby having vertically overlapping portions, (b) a closure for said container including a top wall, a cylindrical side wall depending from said top wall, and thread means for mating with said neck thread means, said closure thread means being formed on a helical path on a surface of said side wall which corresponds to and mates with said neck helical path, said closure helical path extending for more than one full turn around said side wall thereby having vertically overlapping portions, (c) said thread means on one of said neck and closure side wall being a continuous screw thread along the entire length of said helical path on a surface thereof, (d) said thread means on the other of said neck and closure side wall including interrupted thread segments formed on the helical path thereof, said thread segments being spaced from each other by interruptions which are vertically aligned with thread segments formed on an overlapping portion of the helical path, each said interruption being at least as long as a thread segment aligned therewith, (e) said continuous screw thread and said interrupted thread having cooperative lengths which require at least two hand operations to remove the closure from the neck, thereby permitting internal pressure relief through said interrupted threads before the closure thread means are completely disengaged from the neck thread means.

2. A package as defined in claim 1 in which the interruptions between the thread segments exceeds the length of the thread segments aligned therewith, thereby providing directly aligned vertical vent passages to more quickly release the internal pressure from the container.

3. A package, comprising;

(a) a container having a cylindrical neck with an opening formed therein for dispensing the contents, said neck having a continuous screw thread formed on a helical path on the external surface thereof and extending for more than one full turn around said neck, and (b) a closure for said container including a top wall, a skirt depending from said top wall, and thread means for mating with said neck thread, said thread means being formed on a helical path on the inner surface of said skirt which corresponds to and mates with the continuous screw thread helical path on said neck, (c) said closure thread means including interrupted thread segments formed on said closure helical path on the inner surface of said skirt, said closure helical path extending for more than one full turn around said skirt surface thereby having vertically overlapping portions, (d) said thread segments being spaced from each other by interruptions which are vertically aligned with thread segments formed on said overlapping portions of said closure helical path, each said interruption being at least as long as a thread segment aligned therewith.

4. a closure for a container having a neck portion with an opening formed therein for providing access to the interior thereof, the neck portion having a continuous screw thread formed on a helical path on the external surface thereof, comprising:

(a) a top wall, (b) a skirt depending from said top wall, and (c) screw thread means for mating with a neck thread means being formed on a helical path on the interior surface of said skirt, said closure helical path corresponding to and mating with a continuous helical screw thread on the neck of a container which is to receive the closure, (d) said closure screw thread means including a plurality of thread segments formed along and spaced from each other on said closure helical path, (e) said spaced thread segments being located on said closure helical path so that each segment is never vertically aligned on the interior wall of said skirt with any portion of another thread segment, (f) said closure helical path being defined by a beginning leading thread segment and a trailing end thread segment and having a length which extends around the interior surface of said closure skirt for more than one turn and for a distance which requires at least two hand operations by a user to remove the closure from a container neck, thereby permitting internal pressure relief after a first hand operation is initiated by a user and before the closure is completely disengaged from the threads on the neck of a container.

5. A closure as defined in claim 4 in which said closure helical thread path extends for at least 540 helical degrees, and in which said thread segments have a total length of at lesat 270 helical degrees in order to maintain a total of at least three-fourths of a turn of closure-finish thread contact to maintain desired internal pressures for carbonated beverages.

6. A closure as defined in claim 4 in which the spacing between thread segments exceeds the length of the thread segments, thereby providing vent passages to release internal pressures from a container before the closure thread segments are completely disengaged from the threads on the neck of a container.

7. A closure as defined in claim 4 in which each of said thread segments are substantially equal in length, with spacing between thread segments being at least the length of a thread segment, thereby distributing the retaining force exerted by the closure thread segments substantially equally around the skirt of the closure.

8. A closure as defined in claim 7 in which the sum of the number of thread segments and the number of spaces between thread segments in 360 helical degrees of said closure helical path is an odd number in order to provide equally distributed retaining forces for said thread segments on the skirt of said closure.

9. A closure as defined in claim 7 in which said closure helical path extends for about 648 helical degrees.

10. A closure as defined in claim 4 in which all but one of said thread segments are equal in length and in which the remaining thread segment is twice the length of the other thread segments.

11. A closure as defined in claim 10 in which said closure helical path extends for about 600 helical degrees.

12. A closure as defined in claim 4 in which all but one of the interruptions between thread segments are equal length and in which the remaining interruption is twice the length of the other interruptions.

13. A closure as defined in claim 12 in which said closure helical path extends for about 720 helical degrees.

14. A closure as defined in claim 12 in which said closure helical path extends for about 540 helical degrees.

15. A plastic screw closure manufactured by a process which includes stripping the finished closure from a mold, comprising;

(a) a top wall means, (b) a skirt depending from said top wall, and (c) screw thread means for mating with a thread on a neck of a container, said thread means being formed on a helical path on the interior surface of said skirt which corresponds and mates with a continuous helical screw thread formed on the neck of a container which is to receive the closure, said closure helical path extending for more than one full turn around said closure skirt thereby having vertically overlapping portions, (d) said screw thread means including a plurality of spaced thread segments located on said closure helical path so that each segment is never vertically aligned on the interior wall of said skirt with any portion of another thread segment, thereby permitting said closure to be stripped from a mold with a lesser force to reduce stress on the closure threads and avoid damage thereto.

16. A plastic screw closure as defined in claim 15 in which said thread segments are slightly shorter than the spaces between thread segments, thereby further reducing the force required to strip such closure from a mold and enabling more direct venting of internal pressures from the container.

* * * * *